US006543436B2

(12) United States Patent
Montgomery

(10) Patent No.: US 6,543,436 B2
(45) Date of Patent: Apr. 8, 2003

(54) PORTABLE CHUCKWAGON CAMP BOX

(76) Inventor: Dennis Montgomery, 4123 W. Dorian, Boise, ID (US) 83705

( * ) Notice: Subject to any disclaimer, the term of this patent is extended or adjusted under 35 U.S.C. 154(b) by 0 days.

(21) Appl. No.: 10/008,418

(22) Filed: Nov. 6, 2001

(65) Prior Publication Data

US 2002/0078943 A1 Jun. 27, 2002

Related U.S. Application Data

(60) Provisional application No. 60/246,428, filed on Nov. 6, 2000.

(51) Int. Cl.[7] ..... F24C 5/20

(52) U.S. Cl. ..... 126/38; 126/9 R; 126/305; 312/236

(58) Field of Search ..... 126/9 R, 25 R, 126/41 R, 38, 37 R, 37 A, 304 R, 305; 312/236, 272, 289, 316

(56) References Cited

U.S. PATENT DOCUMENTS 1,438,345 A * 12/1922 Tait et al. ..... 126/9 R
1,478,371 A * 12/1923 Albrighton ..... 126/38
1,582,346 A * 4/1926 Oster ..... 126/38
1,617,806 A * 2/1927 Hanson ..... 126/38
1,792,721 A * 2/1931 Wilson ..... 126/38
3,866,994 A * 2/1975 Bonin ..... 312/236

* cited by examiner

*Primary Examiner*—James C. Yeung
(74) *Attorney, Agent, or Firm*—Pedersen & Co. PLLC; Ken J. Pedersen; Barbara S. Pedersen

(57) ABSTRACT

The chuckwagon camp box of this invention includes a portable kitchen comprised of a top lid, drop down front and rear shelves, each of which is separately hinged to a base unit. The underside of the base unit has provisions to removably attach the support legs or permanently attach folding legs. The underside of the base unit also is provided with a plurality of casters to facilitate transport of the camp box. The base unit also includes an integral cooktop accessible from the front shelf and a plurality of work surfaces, multi-purpose compartments and a utensil drawer. Extendable, multi-purpose racks may be withdrawn from both ends of the base unit to serve as towel racks or shelves with the attachment of the included covering trays. A dish-washing center accessible from the rear shelf is also provided. The front and rear shelves are separated by an upstanding, transverse panel in the box, so that the front cooking area and rear washing areas are functionally isolated, separate work stations.

6 Claims, 9 Drawing Sheets

A

B

PORTABLE CHUCKWAGON CAMP BOX

This application claims priority of our prior, abandoned provisional patent application, Ser. No. 60/246,428, filed on Nov. 6, 2000, entitled "Portable Chuckwagon Camp Box," which is incorporated herein by reference.

BACKGROUND OF THE INVENTION

1. Field of the Invention

This invention generally relates to portable camping equipment and more particularly to a chuckwagon camp box containing a portable, fully integrated kitchen used for cattle drives and roundups, military bivouacs, camping, picnics, barbecues and other activities and events at outdoor, undeveloped locations.

2. Related Art

During the regular activities of today's ranches and farms there is a frequent need to prepare meals at remote outdoor locations where the amenities of a conventional kitchen are not available. Such amenities would normally include electric power, cooktops, ovens, dishwashers, and the myriad other modern day appliances. Similarly, outdoor cooking is needed for recreational camping, picnicking, barbecues, "tailgate" parties, military bivouacs and the like.

The ease and indeed pleasure of preparing and partaking of outdoor meals is often compromised by the difficulty and complexity of assembling the necessary equipment and supplies for preparing meals. It is usually difficult to locate, and always awkward to pack, the needed stove, pots and pans, coffeepot, plates, cups, utensils, napkins, and the variety of foods, ingredients and condiments. Once these supplies are located, then comes the task of packing them in various containers such as cardboard boxes, paper and plastic bags, plastic storage boxes and the like. With this mixture of types and sizes of containers it is difficult to pack them compactly and securely in the transport vehicle. Consequently the contents are likely to be damaged as they become loose and shift during transport over the typically rough terrain encountered during such enterprises.

Perhaps even more perplexing is the challenge of repacking these supplies and equipment after their use and prior to moving to the next location or returning home. One has to recall which container was originally used for each item and as everyone has experienced, what was once packed neatly in a container almost never fits when repacked.

As a result, there is a critical need for a system and equipment for compactly providing and securely transporting a portable kitchen. Such a kitchen must include all necessary cooking equipment and storage. It must be portable, ruggedly built, and as lightweight as possible, yet easy to setup and repack. After the equipment is set up for use it must be sturdy and stable. The kitchen food preparation and work surfaces must be at convenient height to facilitate kitchen functionality. Additionally these surfaces must be durable and easy to clean. The overall challenge in providing such a system is to optimize its utility and versatility with respect to its portability, size, weight, manufactureablity and cost.

Such a capability will substantially facilitate preparations for camping, picnicking and the like by thoroughly organizing the equipment and supplies. In effect a portable kitchen can serve as a physical "check list" of the equipment that is required for outdoor cooking. This not only assures that all needed equipment is available but that superfluous equipment is not packed. A further benefit is that when the portable kitchen is not being used it can serve to store most of the kitchen equipment that is typically used only for camping and picnicking.

As will be reviewed in the following paragraphs, various devices have been offered to achieve some of the above described capabilities and benefits. However, none fully meet these long felt needs as well as does the presently disclosed invention.

Hewitt (U.S. Pat. No. 3,289,664) discloses a portable kitchen having a countertop, sink, water faucet, drain, water pump, water supply tank, a stove unit, a "means for supplying heat energy" to the stove and miscellaneous storage areas. This seemingly complete kitchen unit suffers from a lack of compactness and less than complete packaging in that when prepared for transport the water faucet and sink are left unprotected. In addition, valuable space is used for the sink and water "system" which is best provided separately to reduce the volume, weight and transportability of the unit. Also transporting any form of water system subjects the unit to excessive weight, and leakage and potential damage to other items being transported or stored.

Criswell (U.S. Pat. No. 3,543,890) offers a "Camper Kitchen" comprising shelves, storage and retractable legs. No cooking capability is provided and storage space and compartmentation is minimal.

Bernier (U.S. Pat. No. 3,915,529) describes a portable kitchen in a foldable "suitcase like" structure that includes storage, a sink, a stove, a water supply system, external "wings" (work areas), and a plurality of retractable legs. The "foldable" approach to the design of this kitchen detracts from its stability during use. In addition the support legs are stored outside the folded assembly thus exposing them to damage and or entanglement with other objects. The shortcomings with respect to incorporating a water supply system as described above for Criswell's patent also apply to Bernier's disclosure.

Myers (U.S. Pat. No. 4,089,554) presents a foldable kitchen unit that includes an icebox, cooking stove, wash basin, and storage compartments. The bumper of a station wagon or truck must support this unit. No support legs are provided. The use of this unique design is limited since it must be attached to the bumper of a stationwagon or truck.

Lee et.al. (U.S. Pat. No. 5,349,708) disclose a kitchen sink unit comprising two work surfaces, hinged to fold on top of each other. One surface holds a dishwasher bucket, the other a detachable grille. No cooking or storage capability is provided and thus this patent does not meet the minimum requirements for a portable kitchen.

Peterson et. al. (U.S. Pat. No. 5,683,157) discloses a portable kitchen having a table, detachable sink and storage compartments. The unit has no integral cooking capability. The unit is made from a plastic material and folds compactly into a box. The lid of the box serves alternatively as a sink or stand for the main storage box. However, to position the work surfaces at a convenient height, it must be placed on a suitable table or elevated in some other fashion.

Dany (U.S. Pat. No. 6,079,400) has invented a portable camp kitchen having a "cooker" unit (cooktop burners), a telescopic lighting means, and storage. The unit folds into its own box shaped container after first telescoping the light into its storage location. Although providing many features similar to the extant invention, Dany does not offer a comparable variety and extent of storage compartments and work surfaces. In addition Dany does not offer convenient, waist high storage or windscreen capabilities.

The camp box/portable kitchen described herein is an optimum design of the key required kitchen capabilities innovatively constructed and packaged into a portable, compact, rugged and yet light weight unit. In its transport and storage configuration the unit forms a smooth, box like container free of entangling protuberances. A plurality of lifting and transport aids are also provided. When the unit is to be set up as a kitchen, it is simple and quick to unfold and/or set up into a sturdy, fully capable and easy to use kitchen assembly.

In summary, none of the known portable kitchens include the unique and innovative combination of structural and operational features and benefits of the invention disclosed herein.

SUMMARY OF THE INVENTION

As can be clearly seen from the preceding review of the prior related art, there is a long standing need for a readily portable kitchen that provides for storage, cooking, dish-washing and clean up in a compact, rugged and easily set up unit. As described, numerous attempts have been made to accomplish these objectives, with varying degrees of success. Often a potential improvement in any one aspect of the kitchen, for example inclusion of an integral water supply, tends to increase the overall weight beyond acceptable limits and introduces new problems, for example potential water leakage.

Also, in trying to achieve these sometimes conflicting objectives, the approach becomes overly sophisticated leading to more difficult fabrication techniques, expensive components, and increased weight and set up complexity. The invention described herein optimizes the performance of the portable kitchen in the areas of portability, compactness, weight, and overall capability to meet key kitchen requirements at remote locations. This design with its innovative packaging scheme and rugged construction form a highly effective kitchen system.

The camp box of this invention includes a portable kitchen comprised of a top lid, drop down front and rear shelves, each of which is separately hinged to a base unit. The underside of the base unit has provisions to removably attach the support legs, or to permanently attach folding legs. The underside of the base unit also is provided with a plurality of casters to facilitate transport of the camp box.

The base unit also includes an integral cooktop and a plurality of work surfaces, multi-purpose compartments and at least one utility/utensil drawer. Extendable, multi-purpose racks may be withdrawn from both ends of the base unit to serve as towel racks or supports for shelves with the attachment of the included covering trays for shelf tops. The drop-down front and rear shelves are separated by an upstanding transverse panel in the box, so that the front and rear shelves, when down in their opened-for-use position, are functionally isolated from one another by the transverse panel. This way, cooking oils and ashes from the cooktop available from the front shelf do not so readily contaminate or interfere with a washing station conveniently placed on the back shelf. Also this way, especially when the top lid is hinged at the top of the upstanding panel, and adapted to temporarily lock in the vertical position there, the upstanding panel and the vertical top lid serve as an effective windbreak for the cooktop.

These and many other features and attendant advantages of the invention will become apparent, as the invention becomes better understood by reference to the following detailed descriptions and accompanying drawings.

DESCRIPTION OF THE PREFERRED EMBODIMENTS

Figure 1:
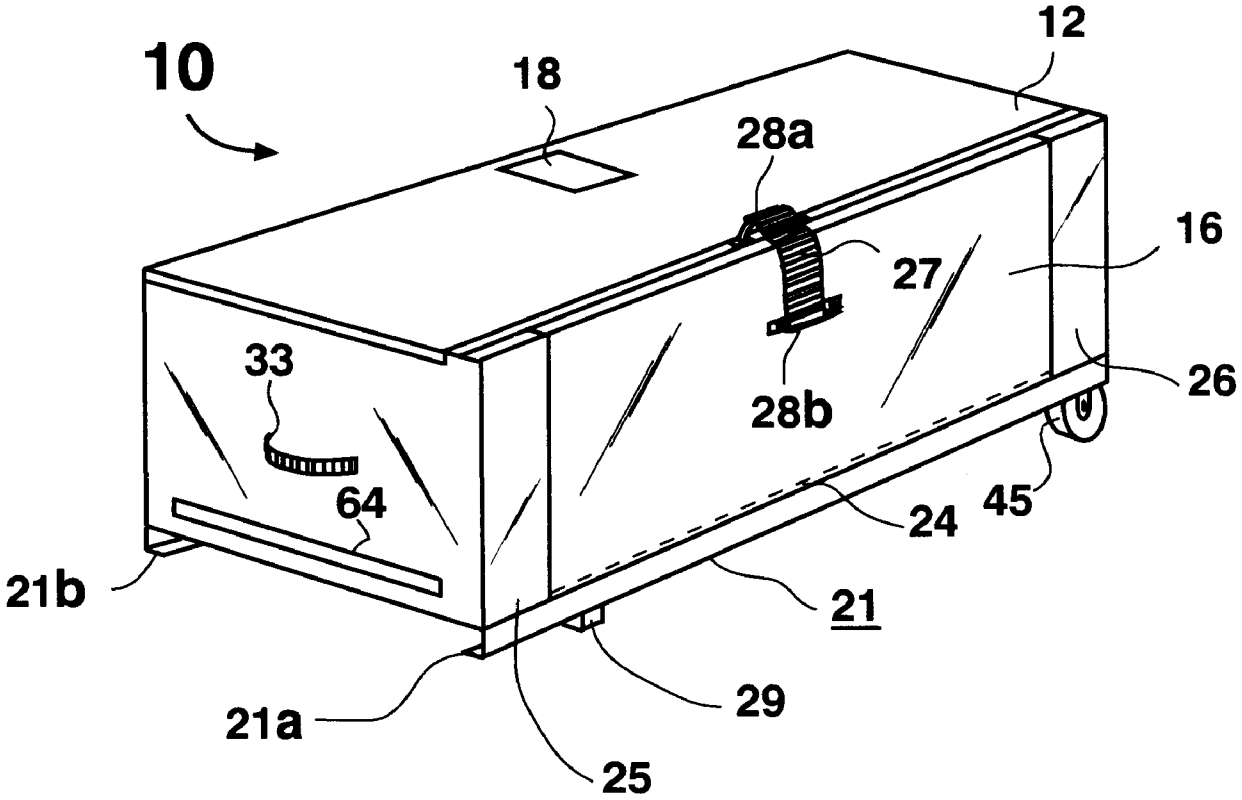
FIG. 1 is an isometric view of the back side and right end of one embodiment of the camp box of the present invention in its closed configuration, ready for storage or transport.
Figure 2:
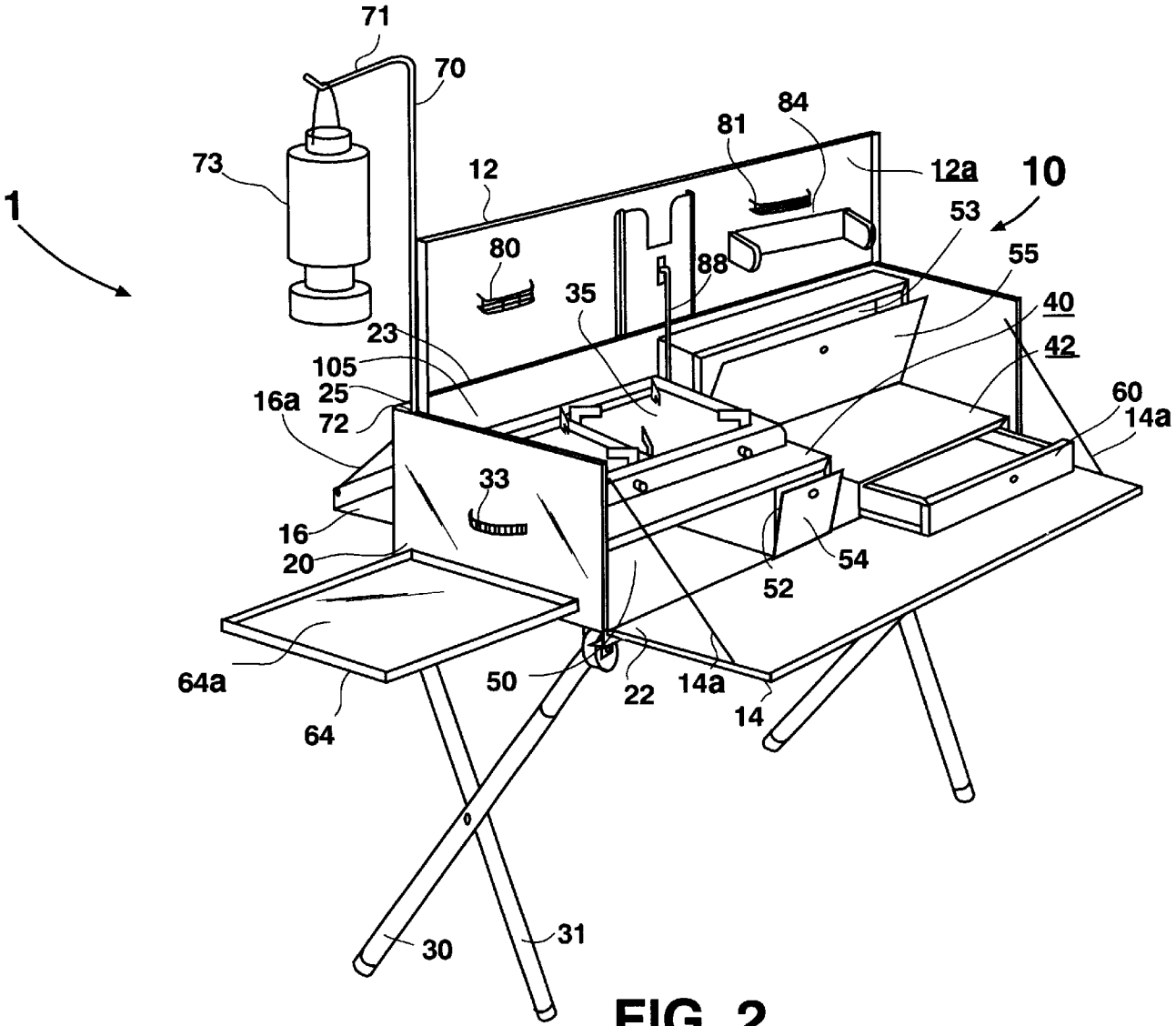
FIG. 2 is an isometric view of the front and the left end of the camp box depicted in FIG. 1 in its deployed and set-up configuration, ready for use as a portable kitchen.
Figure 5:
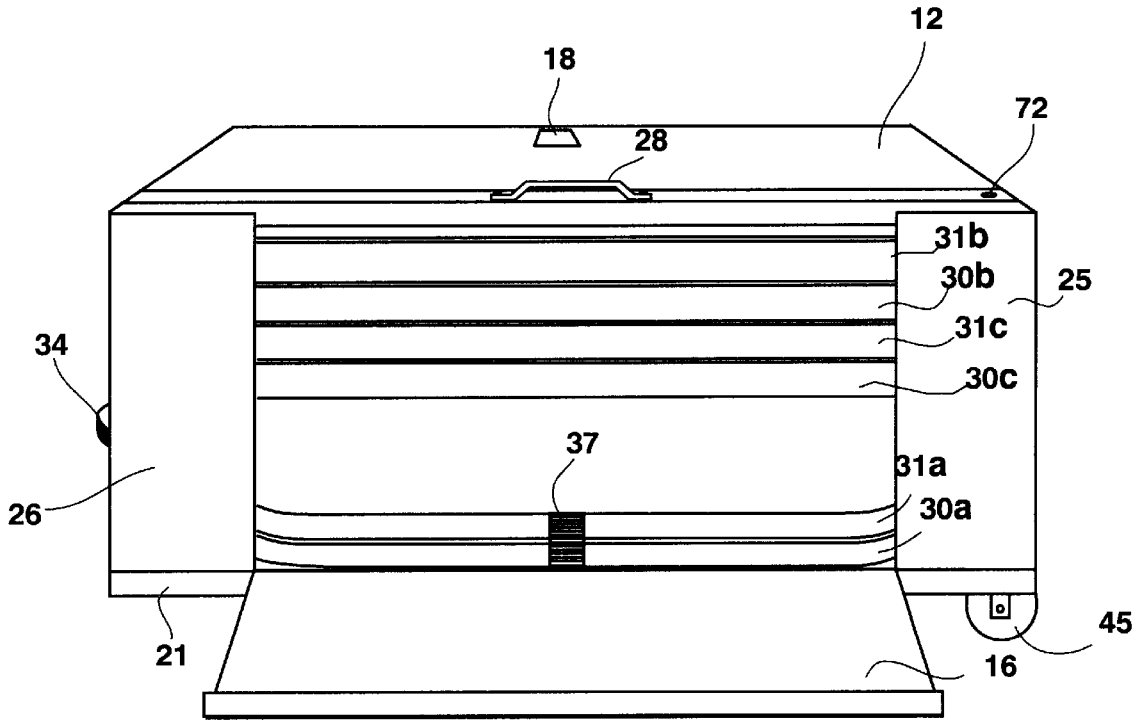
FIG. 5 is a rear view of the camp box depicted in FIG. 4 showing the stowage of the disassembled support legs and the lamppost.
Figure 6:
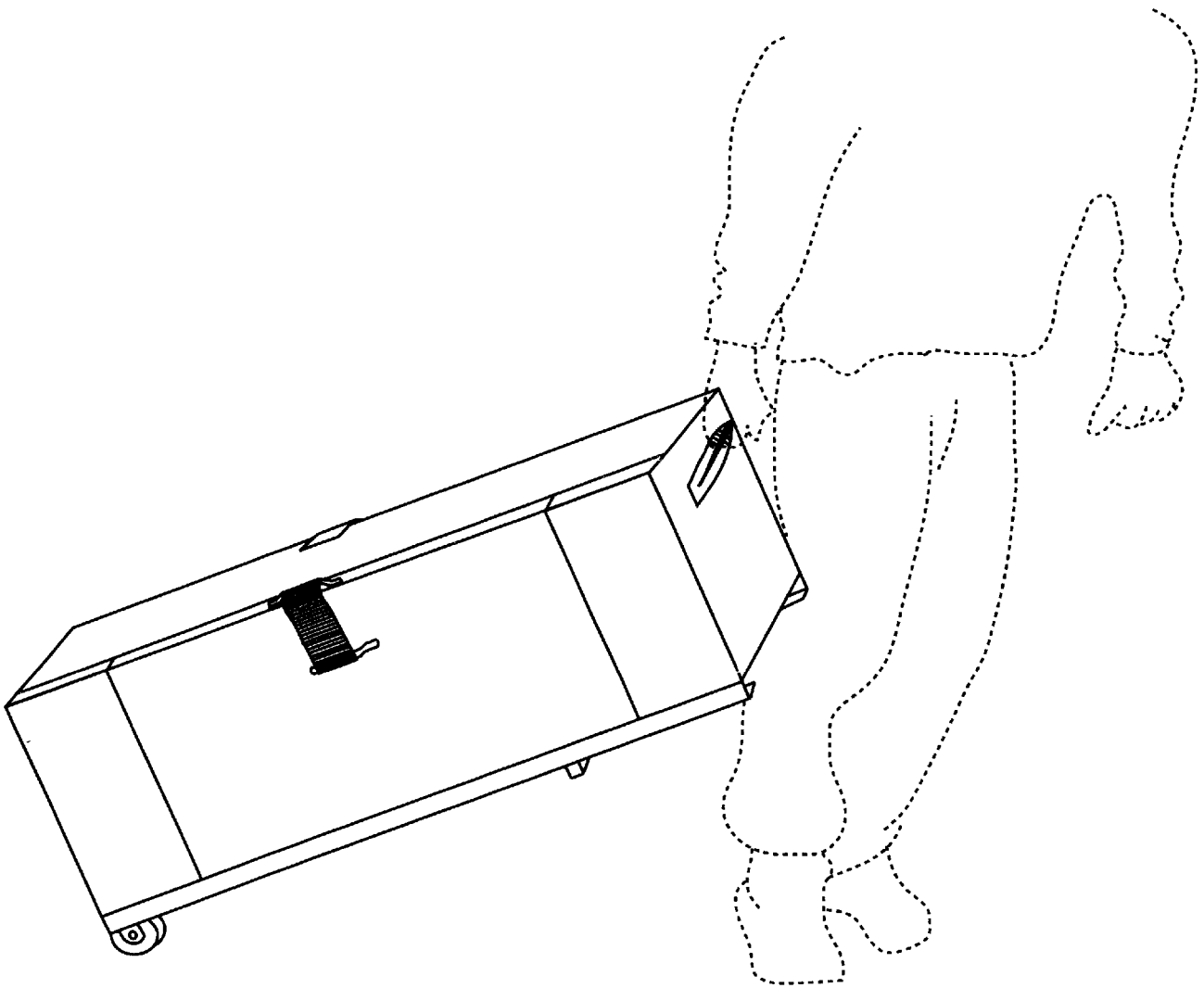
FIG. 6 is an isometric view of one embodiment of the present invention in portability mode.

With reference to FIG. 1, the preferred embodiment of camp box 1 is shown in its closed configuration, ready for storage or transport. Referring now to FIG. 2, camp box 1 is shown in its deployed configuration, ready for use as portable kitchen 10. Portable kitchen 10 is comprised of top lid 12, drop down front shelf 14 and drop down rear shelf 16. Top lid 12 is hingedly connected to transverse, upstanding panel 105 by top hinge 23. Top lid 12 is retained in its vertical raised position by pneumatic strut 88 connected between underside 12*a* of top lid 12 and base unit 20. Front shelf 14 is hingeably connected to base unit 20 by front hinge 22. Rear shelf 16 is hingeably connected to base unit 20 by rear hinge 24. Front shelf 14 and rear shelf 16 are supported in their deployed (i.e. lowered) position by support wires 14*a*, 16*a* respectively. Underside 21 of base unit 20 has support bar 29 for when the closed box is resting on the ground. Next to rear shelf 16 are upwardly-extending leg retainers 25, 26 to secure identical, removable support legs 30, 31 for storage and transport (see FIG. 5, below).

Continuing reference to FIG. 1 and 2, in the preferred embodiment of camp box 1, underside 21 of base unit 20 is provided with a pair of casters 45 and support bar 29 to facilitate transport camp box 1. Left lift strap 33, and right lift strap 34 (shown in FIG. 3) further facilitate transport.

Continuing reference to FIG. 2, camp box 1 also includes an integral cooktop 35 secured to first work surface 40 and an additional second work surface 42. To provide additional versatility, camp box 1 also includes first multi-purpose compartment 50 and second multipurpose compartment 52, the later having a drop down door 54 connected to compartment 52 by hinge 56. A third compartment 53 and utensil drawer 60 are also provided, compartment 53 further including drop down door 55 connected to compartment 53 by hinge 57. Drop down doors 54, 55 are secured in their closed position by commercial magnetic latches (not shown).

In the preferred embodiment, first rack 80 and second rack 81 are provided on the underside 12*a* of top lid 12 for the convenient storage of condiments, spices and other items used in cooking. Paper towel rack 84 is also conveniently located on underside 12*a* of top lid 12. Additional racks and accessories may be placed elsewhere in and on camp box 1 at the discretion of the users however care must be exercised in their placement to assure that the several folding components retain their functionality.

Figure 3:
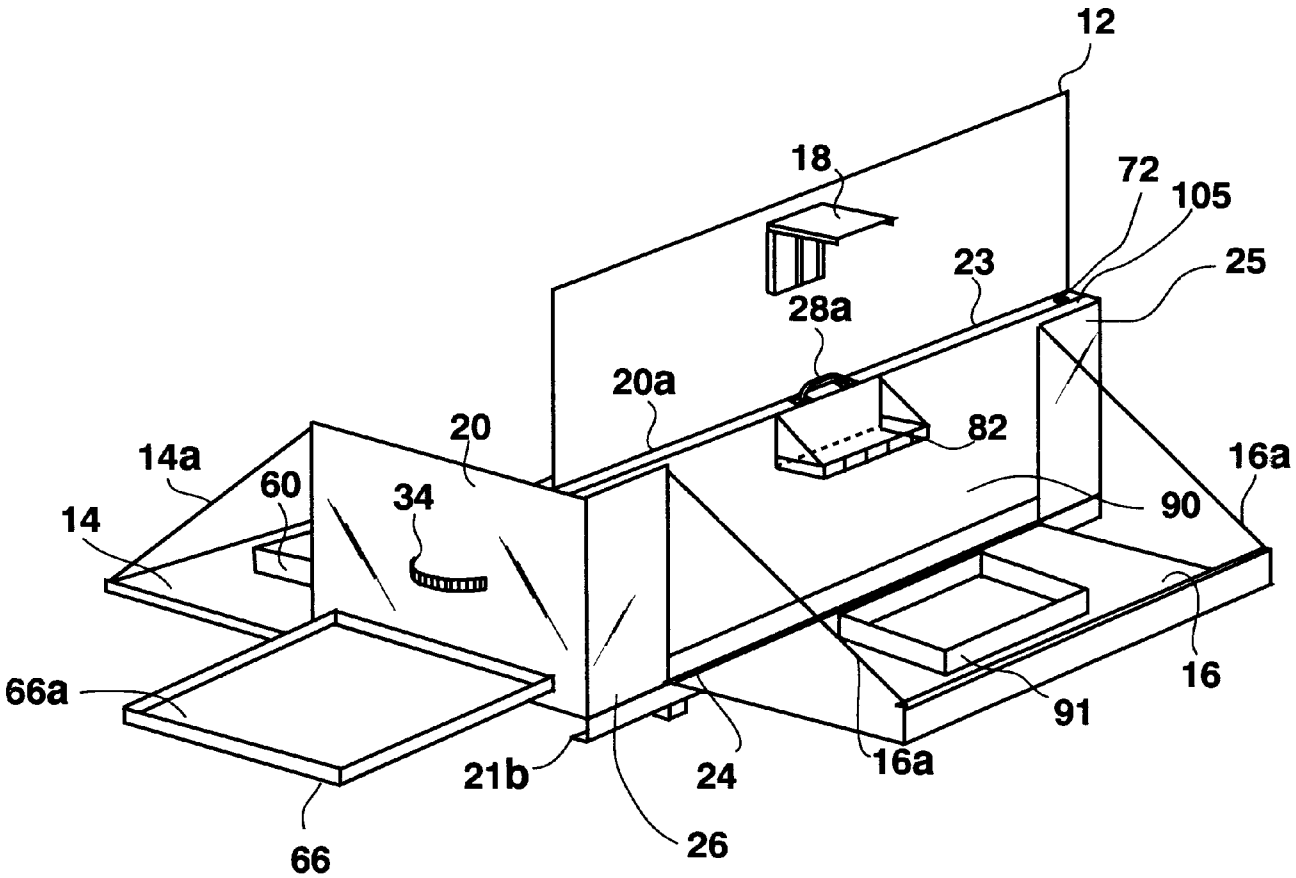
FIG. 3 is an isometric view of the back side and the right end of the camp box depicted in FIGS. 1 and 2 in its deployed configuration, ready for use as a portable kitchen.

With reference to FIGS. 2 and 3, extendable, multipurpose rack supports 64, 66 may be withdrawn from base unit 20 to serve as towel racks, garbage bag holders or shelves. Removable trays 64*a*, 66*a* provide a shelf capability for extended left and right rack supports 64, 66. Lamppost 70 is removably secured to base unit 20 by insertion into hole 72 in base unit 20 and hole 74 (not shown) in first work surface 40. Holes 72 and 74 are aligned so that lamppost 70 is supported vertically. Lamppost 70 has a horizontal lamp support portion 71 to support lamp 73. Lamppost 70 is placed between retainers 25, 25 for storage and transport when the box is closed.

Referring now to FIG. 3, a dishwashing center 90 may be established using lower rear shelf 16 supported by support wires 16a. Removable dishwashing bowl 91 is placed on shelf 16 and third rack 82 is removably secured to upper edge 20*a* of base unit 20. Third rack 82 is conveniently placed above dishwashing bowl 20 for the storage of detergent, scouring pads, scrub brushes and the like. Additional dishwashing and rinsing bowls may also be accommodated on shelf 16 at the discretion of the user. Alternatively dishwashing bowl 91 may be removed and shelf 16 used for any other purpose, cooking or otherwise. For storage and transport of camp box 1, dishwashing bowl 91 may be placed at any suitable location within camp box 1.

Figure 4:
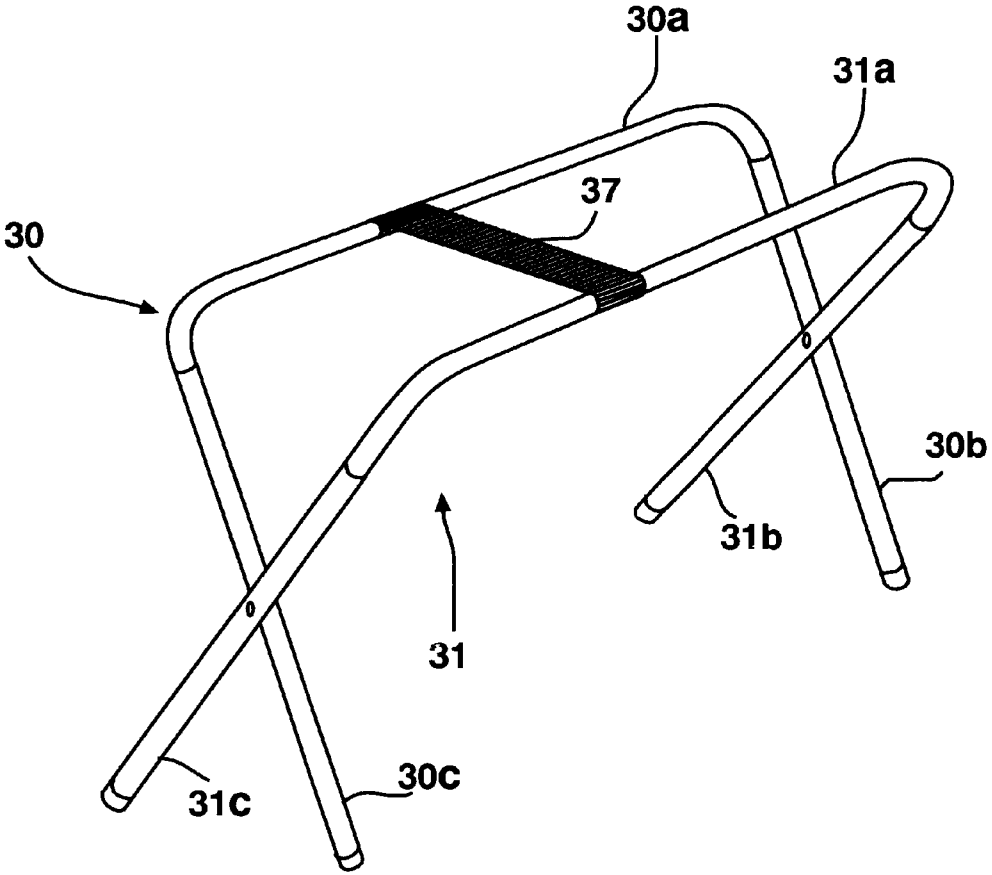
FIG. 4 is an isometric view of the separate support legs in their set up position for one alternative embodiment of the camp box of the present invention.

Referring now to FIG. 4, support legs 30, 31 are identical and are each formed by upper leg sections 30*a*, 31*a* and lower leg sections 30*b*, 30*c*, 31*b*, 31*c*. Lower leg section 30*b* is connected to one end of upper leg section 30*a* and lower leg section 30*c* is connected to the opposite end of upper leg section 30*a*. Similarly lower leg section 31*b* is connected to one end of upper leg section 31*a* and lower leg section 31*c* is connected to the opposite end of upper leg section 31*a*. Lower leg section 30*b* is pivotably connected to lower leg section 31*b* and lower leg section 30*c* is pivotably connected to lower leg section 31*c*. Upper leg section 30*a* is flexibly connected to upper leg section 31 a by leg strap 37 to assure that legs 30, 31 are properly positioned to fit securely between ridges 21*a*, 21*b* on underside 20.

Generally none of the camp box dimensions are critical and thus the dimensions may be altered for specific intended uses. In fact, a family of different sized and configured camp boxes is envisioned. Smaller and lighter weight units may be more suitable for individual or family use and larger sized units may be produced for commercial, ranching or military applications. Similarly the number, size and shape of the included work surfaces, compartments, drawers, racks, etc. may be altered to meet specific application requirements.

In the preferred embodiment, camp box 1 in its closed configuration has an overall length of 39 inches, a height of 16 inches and a depth of 20 inches. Extendable racks 64, 66 extend approximately 11 inches and they are approximately 14 inches wide. Lamppost 70 has a nominal diameter of 0.4 inches and a height of 38 inches. Lamp support portion 71 is 10 inches long. Support legs 30, 31 place second work surface 42 at a nominal height of 36 inches.

In the preferred embodiment, the structural elements (base unit 20, lid 12, shelves 14, 16, compartments 50, 52, 53, doors 54, 55, drawer 60) of camp box 1 are formed from 0.63 inch thick aluminum. All surfaces are painted for additional protection of the sheet metal and to facilitate clean up. All hinges 22, 25, 56, 57 are aluminum, and of the piano type. Extendable racks 64, 66 are formed from flat galvanized aluminum bars, 0.188 inches thick, 0.75 inches wide. Support legs 30, 31 are formed from 1 inch galvanized steel tubing and are unfinished. Racks 80, 81, 82 are standard commercially available vinyl coated steel wire. Paper towel rack 84 is a commercial plastic unit. Lift straps 33, 34 are woven fabric. Casters 45 are standard commercial pieces as is latch 18. Lamppost 70 is formed from 0.4 inch stainless steel rod. Support wires 14*a*, 16*a*, are stainless steel, nominally 1/16-inch diameter. Utensil drawer 60 is supported on standard commercial drawer slides. Cooktop 35, in the preferred embodiment, is a commercial two burner, propane fueled camp stove.

It is important to note that variations in the materials, their sizes and coatings are permissible as long as the alternatives meet the required durability, functionality and strength requirements of the intended application of the camp box.

Camp box 1 is extraordinarily simple and easy to transport, setup (deploy) and breakdown for transport and storage. With reference to FIGS. 1, 2, 3, 4 and 5, to set up the camp box, securing strap 27, which is permanently secured to loop 28*a* and secures rear shelf 16 in its closed position for storage and transport, is removed from loop 28*b*. Legs 30, 31 and lamppost 70 are removed from retainers 25, 26 and assembled with leg connecting strap 37 in place. The camp box is then lifted onto legs 30, 31 placing legs 30, 31 securely between ridges 21*a*, 21*b*. Rear shelf 16 is then secured with its two connecting support wires 16*a* and third rack 82 is removed from its storage location and secured to upper edge 20*a* of base unit 20. Latch 18 is then released and top lid 12 is raised, strut 88 securely and automatically retains top lid 12 in the upright, raised position. Typically raised top lid 12 is used as a windscreen by orienting camp box 1 with the working surfaces 40, 42 in the lee of lid 12. A propane bottle to provide fuel for cooktop 35 is then inserted into third compartment 53 and connected to the cooktop hose termination (not shown). Front shelf 14 is then lowered and secured by its two connecting support wires 14*a*. Or, front shelf 14 may be left up during use to help protect cooktop 35 from wind. At the user's option, extendable racks 64, 66 may be withdrawn from camp box 1 and removable trays 64*a*, 64*b* placed on them as needed. Set up is now completed. Breakdown is accomplished by reversing the above steps.

Figure 7:
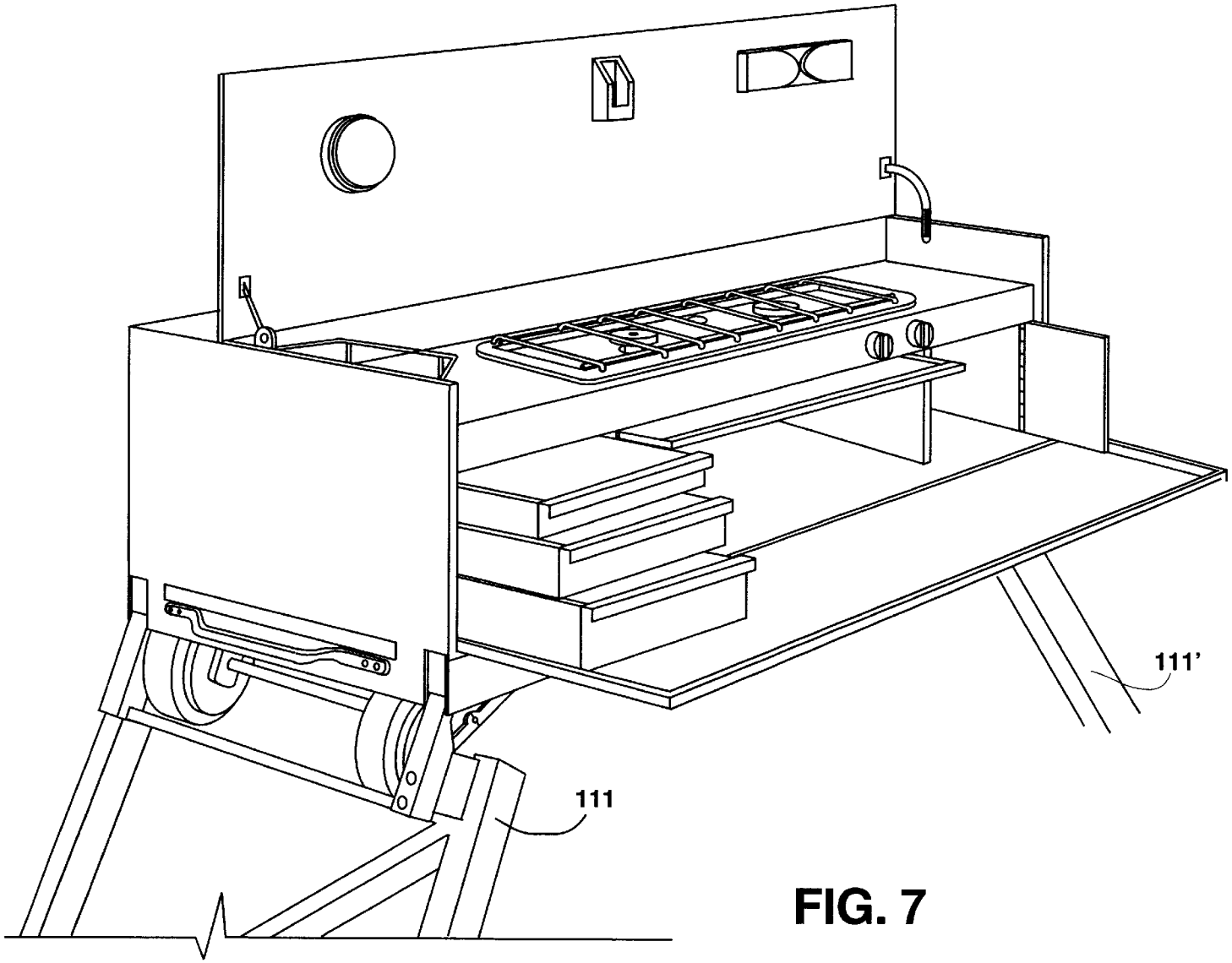
FIG. 7 is an isometric view of the front side and left end of another alternative embodiment of the camp box of the present invention with permanently attached, fold-down legs.

Alternative embodiments of the present invention are contemplated. For example, different lay-outs of the front cooking area, with different work surfaces and drawers and cabinets may be provided as depicted in FIG. 7. Also, different and/or supplemental accessories, such as battery-powered light 101, may also be provided.

Figure 8:
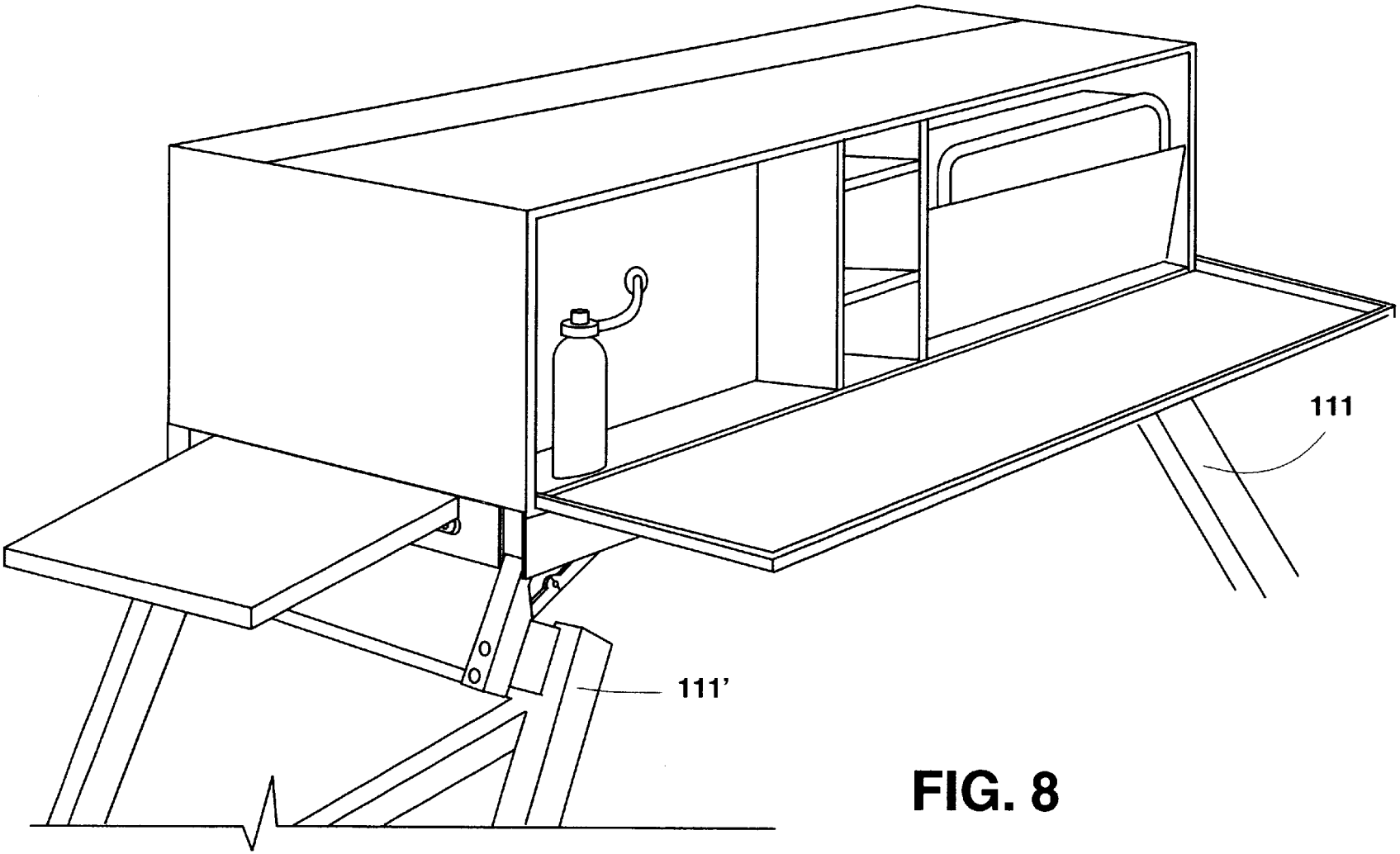
FIG. 8 is an isometric view of the back side and the right end of the camp box depicted in FIG. 7.

Also, for example, different lay-outs of the back washing area, with different compartments and storage areas may be provided as depicted in FIG. 8. Here, for example, cooking gas bottle 103 is safely stored behind upstanding, transverse panel 105 from the front cooking area.

Figure 9:
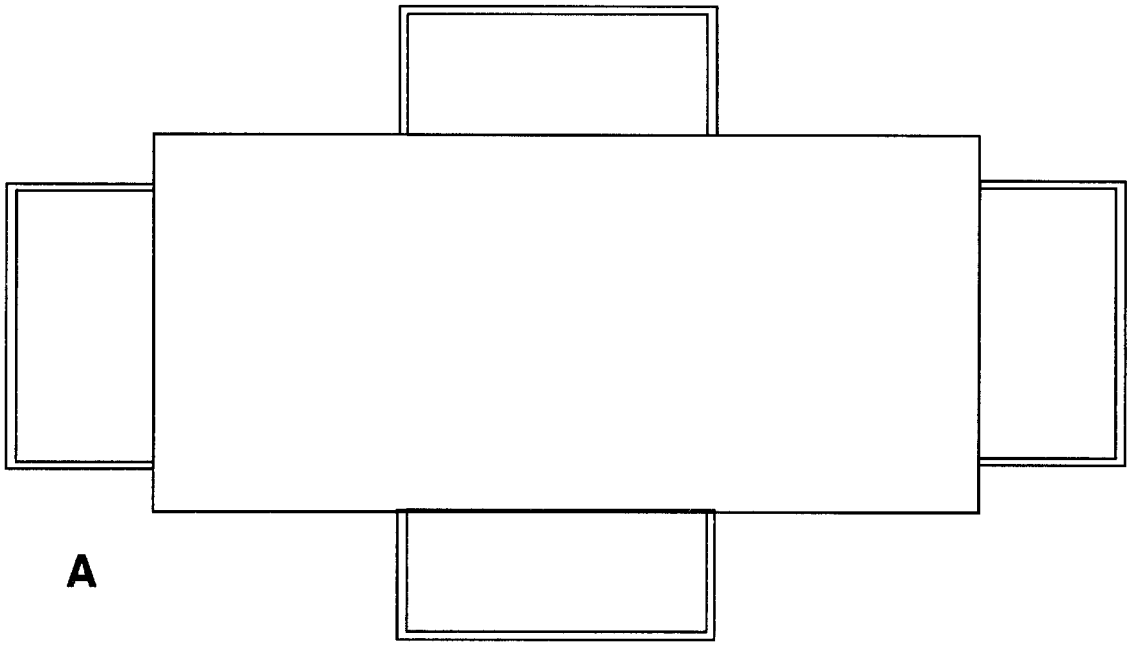
FIGS. 9A and 9B are top and bottom views, respectively, of the camp box depicted in FIGS. 7 and 8 with slide-out shelf supports deployed.
Figure 9:
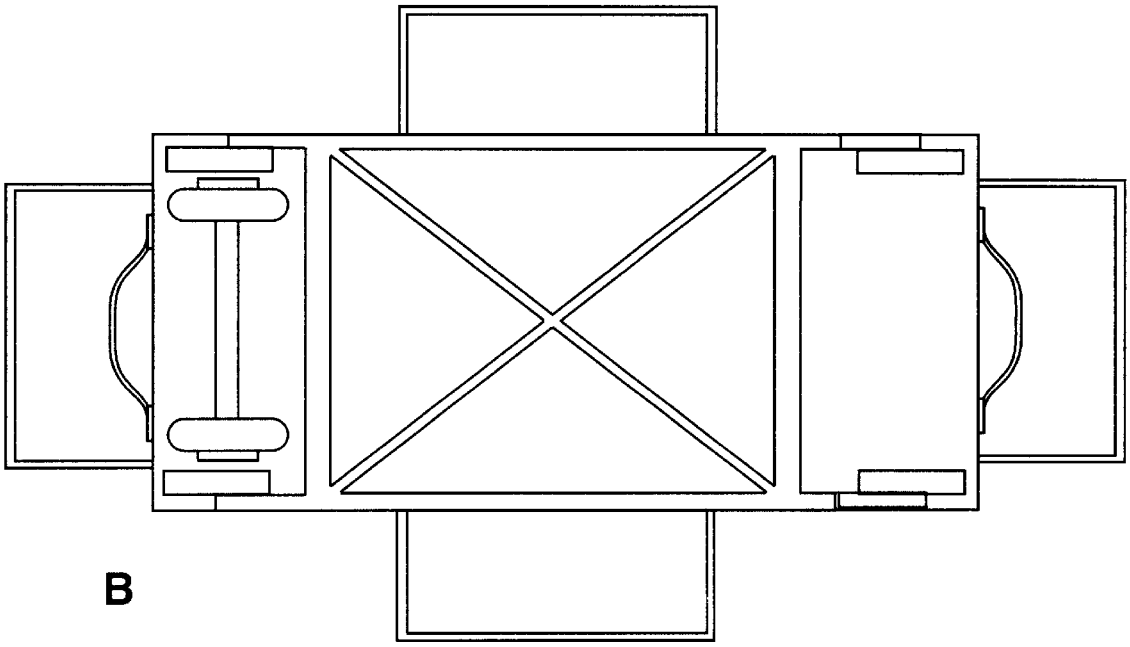

Also, for example, different shelf and shelf support lay-outs may be provided. For example, pull-out drawer supports 107, 107', and 109 and 109' as depicted in FIGS. 9A and 9B may be used for the front, back and side shelves.

Also, for example, permanently-attached folding legs 111 and 111', instead of the removable legs described earlier, may be provided. In all cases, whether the legs are permanently-attached or removable, the bottom of the instant camp box is adapted so that it may rest evenly and opened for use without deploying the legs at all, for example, in the bed of a pick-up truck or on a picnic table.

What is required is that transverse, upstanding panel 105 effectively divide and isolate the front cooking area and front shelf 14 from the back washing area and back shelf 16. This way, a vertical support is best provided for top hinge 23 and top lid 12. Also, this way, an effective windbreak is provided for the cooking area, especially when top lid 12 is temporarily locked in its open, vertical position. Also, this way, an effective insolation and protection of the back washing area from the typically dirtier, greasier front cooking area is provided. Also, this way, additional options for storage compartments both in front of and behind the transverse, upstanding panel 105 is provided.

Although this invention has been described above with reference to particular means, materials and embodiments, it is to be understood that the invention is not limited to these disclosed particulars, but extends instead to all equivalents within the scope of the following claims.

I claim:

1. A portable camp kitchen, comprising:

a hinged top lid, bottom, and two ends;

separately hinged drop down front and back sides which are both connected near said bottom, and adapted to become substantially horizontal shelves for front and back work areas, respectively; and a transverse, upstanding panel extending between two said ends, and between said front and back sides to create said front and back work areas, and to create storage compartments both in front of and behind said transverse upstanding panel;

there being a cooktop in one of said work areas, and a washing station in the other of said work areas.

2. The portable camp kitchen of claim 1 which also comprises casters on said bottom for rolling portability of said camp kitchen.

3. The portable camp kitchen of claim 1 which also comprises legs adapted to be connected to said bottom to provide self-standing capability for said camp kitchen.

4. The portable camp kitchen of claim 3 wherein the legs are removable and storable within said camp kitchen.

5. The portable camp kitchen of claim 3 wherein the legs are permanently attached and foldable underneath said camp kitchen.

6. The portable camp kitchen of claim 1 wherein the top lid is hingedly connected to the top of said transverse, upstanding panel.

* * * * *